United States Patent [19]

Paulet et al.

[11] Patent Number: 4,645,580

[45] Date of Patent: Feb. 24, 1987

[54] PROCESS FOR GALVANIC DEPOSITION OF A DISPERSION COATING, APPLICATION OF SAID PROCESS AND DEVICE FOR PERFORMING SAID PROCESS

[75] Inventors: Jean-Francois Paulet, Siblingen, Switzerland; Heinz Steup, Donaueschingen, Fed. Rep. of Germany

[73] Assignee: Swiss Aluminium Ltd., Chippis, Switzerland

[21] Appl. No.: 818,482

[22] Filed: Jan. 13, 1986

[30] Foreign Application Priority Data

Jan. 17, 1985 [CH] Switzerland ..... 207/85

[51] Int. Cl.[4] ..... C25D 17/00

[52] U.S. Cl. ..... 204/272

[58] Field of Search ..... 204/272, 273

[56] References Cited

U.S. PATENT DOCUMENTS

| | | | |
|---|---|---|---|
| 3,922,208 | 11/1975 | Cordone | 204/272 |
| 4,085,010 | 4/1978 | Ishimori | 204/272 |
| 4,174,261 | 11/1979 | Pellegrino | 204/273 |
| 4,498,967 | 2/1985 | Paulet | 204/272 |

*Primary Examiner*—T. M. Tufariello

*Attorney, Agent, or Firm*—Bachman & LaPointe

[57] ABSTRACT

A process and device for galvanic deposition of a dispersion coating on the cylindrical or slightly conical inner face of a cathode workpiece effect the continuous feed of a circulating electrolyte containing metal ions and suspended, fine-grained hard particles. The cathodically polarized workpiece or its inner face is employed at least as the upper part of the outer wall of the ring-shaped electrolyte container. This inner face is fed electrolyte in the form of a rising, spiral-shaped but vortex-free stream. The process is employed for all cylindrical or slightly conical metallic inner faces which are at least open on one side, in particular for coating brake drums made of aluminum or an aluminum alloy.

10 Claims, 1 Drawing Figure

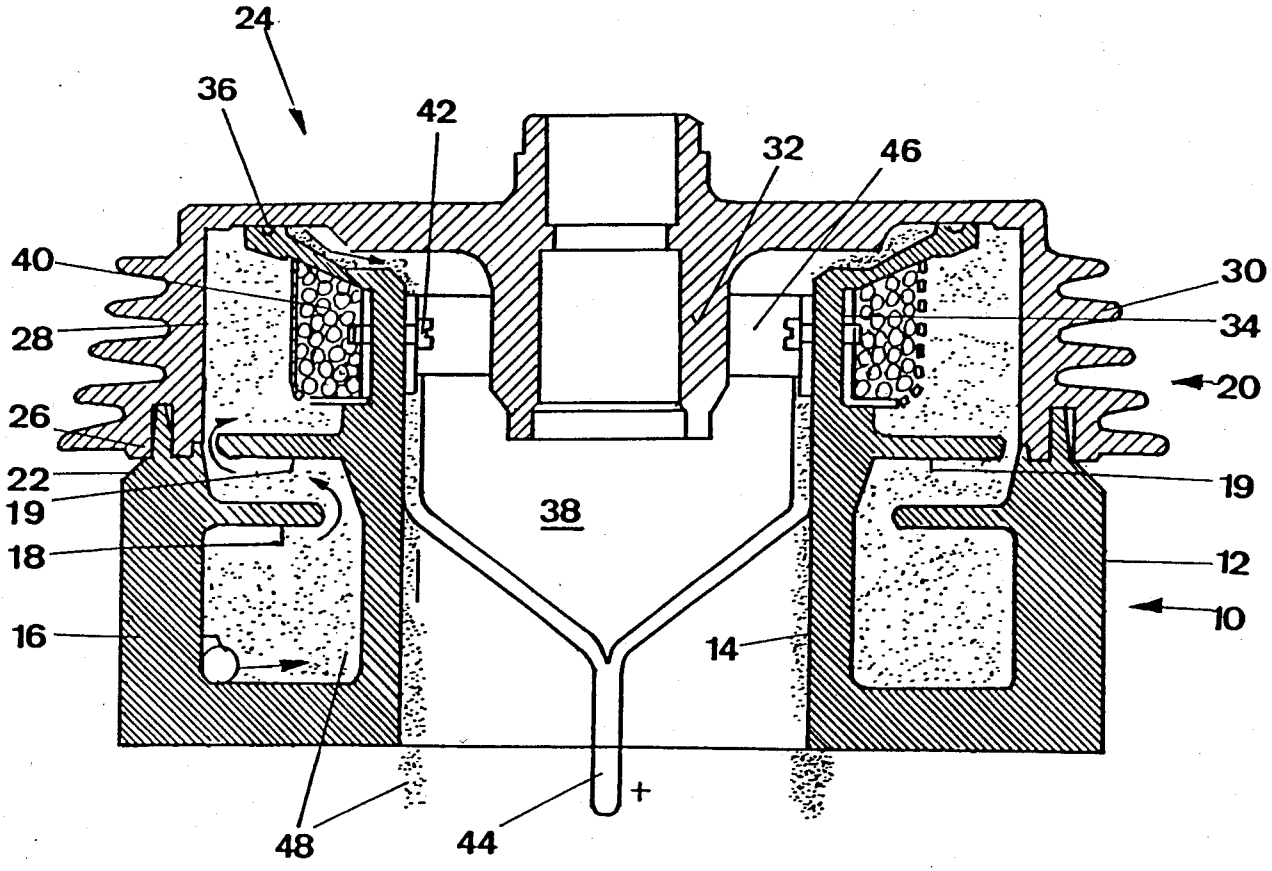
30
34
20
19
12
10
46
32
14
38
+
44
42
48
24
36
40
28
26
22
19
18
16

PROCESS FOR GALVANIC DEPOSITION OF A DISPERSION COATING, APPLICATION OF SAID PROCESS AND DEVICE FOR PERFORMING SAID PROCESS

BACKGROUND OF THE INVENTION

The invention relates to a process for galvanic depostion of a dispersion coating, having a metallic matrix and fine grained particles of hard material uniformly distributed therein, on the cylindrical or slightly conical, metallic inner face of a cathodically connected workpiece by continuous feed of a circulating electrolyte containing metal ions and suspended, fine grained hard particles. The invention relates also to the use of the process and a device for performing the said process.

In many cases the use of metals in industrial fields requires an improvement in surface properties, in particular wear resistance, hardness and sliding properties. Many of the applications open to aluminum in the automobile and machine construction industries can be realized only in combination with hard and wear resistant coatings. The galvanic deposition with a metal layer and simultaneous incorporation of hard particles in the layer to give a dispersion-type coating provides a simple and, for many wear problems, suitable possibility for improving the surface and its mechanical properties.

Such dispersion coatings, mostly of the nickel/silicon-carbide system, exhibit many combinations of properties as a result of varying the matrix material, particulate material, particle size and distribution. The production of galvanically deposited dispersion coatings has been known for some decades now. The British Pat. No. 860 291 for example describes a coating process wherein an electrolyte is fed to a tank via a supply pipe above the tank, is removed again from the bottom of the tank and fed to the electrolyte circuit. The body which is to be coated on the surface rotates in the electrolyte. Parts of the surface which are not to be galvanically coated must be coated e.g. with lacquer or paint before immersion in the electrolyte. After the galvanic coating has been deposited, a considerable amount of subsequent treatment is necessary because the coating is very rough. Another problem is that incorporation of the solid particles in the precipitated metal varies very markedly, according to the conditions of electrolyte flow; uniform coatings are not possible via British Pat. No. 860 291. If internal faces of a hollow body are to be coated, the blisters formed during immersion produce a further detrimental effect on the coating process.

In the technical journal "Oberflächentechnik" (1975) pp 42–52 it has been pointed out that the movement of the electrolyte has a large effect on the rate of incorporation of hard particles in the metal being deposited. It is proposed there to effect movement of the electrolyte by blowing air into the bath, rotating the electrolyte or stirring it mechanically. The resultant movement of the electrolyte is intended to enable the solid particles to be transported with the electrolyte above the workpiece so that, under the influence of gravity, they can settle on the surface of the workpiece and be bonded there by the metal coating. It has, however, been found that all these methods are unsuitable in as much as they lead to inhomogeneity or concentration differences of hard suspended particles in the electrolyte and thus also result in irregular rates of incorporation of the dispersoid. Changes in turbulence along the workpiece to be coated always yield irregular deposition of the solid component.

Described in the German patent publication DE-OS No. 31 42 739 is a process and device for depositing a dispersion coating on hollow workpieces without suffering from the above mentioned disadvantages. To this end the hollow, in particular a cylindrical or conical workpiece is used as part of the electrolyte container and electrolyte is fed to the inner face via a moving supply line i.e. the means of feeding the suspension type electrolyte is moved along the surface of the workpiece to be coated.

SUMMARY OF THE INVENTION

The object of the present invention is to achieve more economically with simpler means the good, uniform coating structure which can be obtained using German patent publication DE-OS No. 31 42 739.

This object is achieved by way of the present invention in that the cathodically connected hollow workpiece with cylindrical or slightly conical inner face is employed at least as the upper part of the outer wall of the ring-shaped electrolyte container and electrolyte fed to this inner face in a rising spiral-shaped but vortex-free manner.

According to this simple concept neither a motor nor another mechanically actuated component need be employed. Thanks to the spirally rising flow of electrolyte the contact time of the electrolyte with the inner face of the workpiece is exceptionally long. The vortex-free, practically laminar uniform flow enables larger and more uniform rates of formation of dispersion coatings.

The vortex-free flow in the region of the cylindrical or slightly conical inner face of the workpiece is preferably created such that this delimits to the outside and upper ring-shaped space. Below this, in a lower ring-shaped space, the electrolyte is made to flow in a circular, turbulent manner in that a tangentially situated supply pipe connects up with the lowest region of this ring-shaped space. Provided in the upper region of the ring-shaped space are at least two baffles which break the turbulence and conduct the electrolyte in a vortex-free manner into the lowest region of the inner face to be coated where the flow progresses in a laminar manner and changes over to the rising spiral-shaped movement according to the invention.

Above the cylindrical or slightly conical inner face of the workpiece which is to be coated the electrolyte usefully flows into the inner region of the ring-shaped electrolyte container. There the electrolyte is collected and, via a circulating pump, reintroduced tangentially into the lowest region of the lower ring-shaped space.

During the coating process the electrolyte and the hard particles in it are slowly but steadily consumed. Replenishing the electrolyte with hard particles takes place, if at all, in dosed amounts or continuously. Replenishing the electrolyte with the metal ions that are deposited to form the matrix is preferably carried out by positioning in the electrolyte container an anode which comprises at least in part of the metal in question. As a result, during the electrolytic process the same amount of metal is dissolved from the anode as is deposited on the cylindrical or slightly conical inner face of the workpiece which is to be coated.

BRIEF DESCRIPTION OF THE DRAWING

The invention is explained in greater detail as set out hereinbelow by means of an example with the aid of the single schematic FIGURE. This shows a vertical cross-section through a device for depositing dispersion coatings on the brake drums for automobile wheels, wherein a brake drum is shown set on top of the cell.

DETAILED DESCRIPTION

The electrolyte can be circulated through one or more cells to form dispersion coatings according to the invention. With larger production series further economic advantages can be achieved by feeding cells in series from one electrolyte container.

The process can be employed for all cylindrical or slightly conical metallic inner lying faces which are open on at least one side.

It has been found particularly advantegeous to employ the process for coating the working surface of a brakedrum which is employed as the workpiece in the process especially if it is made of aluminum or an aluminum alloy.

With respect to the device of the present invention, the foregoing objectives are achieved by way of the invention in that:

the electrolyte container comprises essentially a lower ring-shaped space with an electrolyte supply pipe connecting tangentially to its lowest region, at least two baffles situated in the upper region for breaking the turbulence and, an upper ring shaped space which is open downwards at the periphery and is delimited by the cylindrical or slightly conical inner face of the workpiece as the outer wall, the uppermost baffle as floor, the extension of the lower ring-shaped space as inner wall and the workpiece and/or an angular or bent over part of the inner wall as ceiling, the ring-shaped anode is secured to the inner wall of the upper ring-shaped space of the electrolyte container and can be supplied with electric current via conductor leads passing through the interior of the electrolyte container, and channels situated above the level of the cylindrical or slightly conical inner face of the workpiece which lead from the upper ring-shaped space to the interior of the electrolyte container.

The lower ring-shaped space in the electrolyte container, the baffles and the inner wall of the upper ring-shaped space, including a part which may form the ceiling, are preferably made of a mechanically stable, corrosion resistant and heat resistant plastic. In practice polyethylene and polypropylene have proved to be particularly good for this purpose. The above mentioned, shaped parts of the electrolyte container of the cell that do not belong to the workpiece can, however, be of a corrosion resistant metal, in particular of easily formable aluminum or alloys thereof. In the latter case, however, all possible connections to the cathodically polarized workpiece and the anode must be carefully insulated. Materials and process known to the expert in the field are employed for insulating or coating the aluminum.

The baffles provided in the upper region of the lower ring-shaped space are usefully disc shaped and are alternately connected to the inner and outer walls of the lower ring-shaped space. In all cases, however, the uppermost baffle must be connected to the inner wall and its periphery arranged in the lowest region of the cylindrical or slightly conical shaped inner wall of the workpiece to be coated, at the same time forming a ring-shaped gap.

Although the anodes can readily be of an inert material that supplies no cations to the electrolyte, and can be in the form of hollow anodes, ring-shaped basket type anodes are preferred. These contain stabilizing elements e.g. a mesh and/or supporting elements of an inert metal. Situated in the basket are small spheres or pellets of the coating metal which dissolve during the electrolytic process, thus forming the corresponding cations. The mesh of inert material, for example titanium, is not attacked.

Referring specifically to the drawing, the cell with the essentially ring-shaped electrolyte container has a lower ring-shaped space made of polypropylene which is delimited by a thick outer wall 12 and a thinner inner wall 14. To be seen in the lowest region of the lower ring-shaped space 10 is the supply pipe 16 which feeds the electrolyte 48 tangentially into the said space 10. The electrolyte 48 rises in a turbulent circulating manner and reaches the lower circular baffle 18 which is attached to the outer wall. After being deflected to the slightly inclined inner wall 14, the electrolyte reaches the upper, likewise circular baffle 19 which is shaped out of the inner wall 14 and separates the lower ring-shaped space 10 from the upper ring-shaped space 20 of the electrolyte container.

The upper edge 22 of the outer wall 12 of the lower ring-shaped space 10 features projections which run around the whole periphery. These are designed such that they fit into corresponding recesses in the lower edge 26 of the brake drum 24. This brake drum has a cylindrical inner face 28 the brake workface which is to be coated. Further, the brake drum features a plurality of cooling fins 30. The hub 32 of the brake drum extends into the interior of the electrolyte container 10, 20.

The face 28, to be coated of the brake drum 24 which is installed here as workpiece is at the same time the outer wall of the upper ring-shaped space 20. The inner wall 34 of the upper ring-shaped space is an extension of the inner wall 14 of the lower ring-shaped space 10. The upper part of the inner wall 34 is inclined inwards, forms part of the ceiling and runs close to or up to the brake drum 24.

In the upper ring-shaped space 20 the electrolyte 48 rises slowly in a spiral manner and flows in a uniform vortex-free laminar manner along the inner face 28. This ensures a long contact time between the inner face 28 of the brake drum 24 and the electrolyte 48 containing a suspension of hard particles, which ensures the build-up of a uniform dispersion coating at high formation rates.

After reaching the ceiling which is partly formed by the brake drum 24, the electrolyte flows through the channel 36 in the uppermost region of the wall 34, towards the interior 38 of the electrolyte container 10, 20. Not shown in the FIGURE is that the electrolyte is collected below the cell and reintroduced into the feed pipe 16 by a circulating pump.

The anode 40 is secured in the upper ring-shaped space 20 to the inner wall 34 and to the outward sloping part thereof. It comprises a basket with a mesh of titanium containing nickel spheres. The attachment is made by means of titanium screws 42 which also ensure the electrical contact between the anode basket and the positive conductors 44 of the electric circuit.

The anodic pole conductors 44 are connected to a direct current source not shown in the FIGURE the corresponding negative pole leads to the brake drum 24.

In the present case the titanium screws 42 secure a titanium ring 46 which is connected in all to six electrical conductors 44 which are likewise made of titanium, but if desired can at least in part be replaced by copper conductors.

The path taken through the cell by the electrolyte 48 with its suspended solid particles is sketched out by means of arrows.

What is claimed is:

1. Device for galvanic deposition of a dispersion coating on a workpiece wherein said coating has a metallic matrix and fine-grained particles of hard material uniformly distributed therein which comprises an electrolyte container having a lower ring-shaped space and an upper ring-shaped space communicating therewith to provide an electrolyte path from the lower space to said upper space, an electrolyte supply pipe for feeding electrolyte tangentially to said lower space, at least two baffles in said electrolyte path from the lower to upper space for breaking the electrolyte turbulence, wherein said upper ring-shaped space is open downwards at the periphery and is delimited by the cylindrical or slightly conical inner face of the workpiece as the outer wall, a ring-shaped anode secured to the inner wall of the upper ring-shaped space of the electrolyte container and conductor means for supplying said anode with electric current, and channels situated above the level of the cylindrical or slightly conical inner face of the workpiece leading from the upper ring-shaped space to the interior of the electrolyte container.

2. Device according to claim 1 wherein said lower space includes and outer wall with recesses for interlocking with the correspondingly shaped lower edge of the workpiece.

3. Device according to claim 1 including an uppermost baffle as the floor of the upper space.

4. Device according to claim 1 wherein said lower space includes an inner wall with an extension thereof as inner wall of the upper space.

5. Device according to claim 1 wherein the workpiece includes an upper angular part as ceiling of the upper space.

6. Device according to claim 4 wherein said conductor means pass through said inner wall.

7. Device according to claim 4 in which the lower ring-shaped space, the baffles and the inner wall of the upper ring-shaped space include a part made of corrosion resistant material which is insulated from the workpiece and the anode.

8. Device according to claim 1 including baffles which are disc shaped and are attached alternately to the inner wall and outer wall of the lower ring-shaped space, and an uppermost baffles attached to the inner wall and its periphery arranged in the lowest region of the cylindrical or slightly conical inner face such that it forms a ring-shaped gap.

9. Device according to claim 1 in which the anode is in the form of a basket containing metallic spheres.

10. Device according to claim 9 wherein said basket and the electrical conductor means are made of titanium, and said spheres of nickel.

* * * * *